US006058282A

United States Patent [19]

Ghosh et al.

[11] Patent Number: 6,058,282

[45] Date of Patent: May 2, 2000

[54] ELECTROSTATOGRAPHIC APPARATUS USING ALLOYED ZIRCONIA CERAMIC PROVIDING IMAGE RECEIVING SURFACE

[75] Inventors: Syamal K. Ghosh; Dilip K. Chatterjee, both of Rochester; Dinesh Tyagi, Fairport, all of N.Y.

[73] Assignee: Eastman Kodak Company, Rochester, N.Y.

[21] Appl. No.: 09/157,454

[22] Filed: Sep. 21, 1998

[51] Int. Cl.[7] ..... G03G 15/00

[52] U.S. Cl. ..... 399/159; 399/162; 430/56

[58] Field of Search ..... 399/159, 162, 399/161; 430/31, 56, 54, 60; 101/453

[56] References Cited

U.S. PATENT DOCUMENTS

| | | | |
|---|---|---|---|
| 3,706,489 | 12/1972 | Moxness et al. | 399/161 |
| 3,709,683 | 1/1973 | Ciuffini et al. | 430/54 |
| 4,456,060 | 6/1984 | Stanton . | |
| 5,104,757 | 4/1992 | Koyama et al. | 430/60 |
| 5,391,841 | 2/1995 | Quick . | |
| 5,543,269 | 8/1996 | Chatterjee et al. . | |
| 5,743,188 | 4/1998 | Ghosh et al. | 101/453 X |
| 5,836,248 | 11/1998 | Jarrold et al. | 101/453 |
| 5,839,370 | 11/1998 | Chatterjee et al. | 101/453 X |
| 5,855,173 | 1/1999 | Chatterjee et al. | 101/453 |
| 5,870,956 | 2/1999 | Ghosh et al. | 101/453 |

FOREIGN PATENT DOCUMENTS 145581 12/1980 Germany .

*Primary Examiner*—Susan S. Y. Lee
*Attorney, Agent, or Firm*—Raymond L. Owens

[57] ABSTRACT

An electrostatographic apparatus for providing images on a receiver, including an electrostatographic element movable along a path, having a substrate, an alloyed zirconia ceramic layer formed over the substrate and having an image receiving surface; and the image receiving surface of the alloyed zirconia ceramic layer being adapted to become electrically conductive when illuminated by a light source. The image receiving surface is illuminated with light in the pattern corresponding to an image so that the image receiving surface has electrically conductive and nonconductive portions which taken together represent the image. The image receiving surface is charged such that charge remains on the nonconductive portions of the image receiving surface. Toner particles are provided which adhere to the image receiving surface in the electrically conductive portions defining a developed image. Charged toner particles defining the developed image are transferred to the receiver and then the charged toner particles are fixed to the receiver.

6 Claims, 1 Drawing Sheet

ELECTROSTATOGRAPHIC APPARATUS USING ALLOYED ZIRCONIA CERAMIC PROVIDING IMAGE RECEIVING SURFACE

CROSS REFERENCE TO RELATED APPLICATION

Reference is made to commonly assigned U.S. patent application Ser. No. 08/754,454 filed Nov. 21, 1996, entitled "Zirconia Ceramic Members With Laser Induced Electrical Conductivity In Surfaces Thereof" by Ghosh et al, the disclosure of which is incorporated by reference.

FIELD OF THE INVENTION

This invention relates to an electrostatographic apparatus for making images on a receiver.

BACKGROUND OF THE INVENTION

In electrostatography, an image comprising a pattern of electrostatic potential (also referred to as an electrostatic latent image), is formed on a surface of an electrostatographic element wherein the latent imaged area is sufficiently conductive with respect to the un-imaged area and is then developed into a toner image by contacting the latent image with an electrographic developer. If desired, the latent image can be transferred to another surface following development. The toner image may be transferred to a receiver, to which it is fused, typically by heat and pressure.

Electrostatographic apparatus such as copiers and printers operate through a series of well known steps. These steps include: (1) charging of an insulating photoconductive surface with electrostatic charges, (2) forming an electrostatic latent image by selectively discharging areas on such surface, (3) developing the latent image with toner particles, (4) transferring the toned image to a receiver for fusing thereon, and (5) cleaning by removing residual toner in preparation for similarly reusing the same surface for another such image.

Toners contain a binder and other additives, such as colorants. Electrostatographic toners are commonly made by polymerization of a binder followed by mixing with various additives and then grinding to a desired size range. Electrostatographic apparatus used to generate the latent image is constantly subjected to wear due to mechanical abrasions. The attrition can come from various sources including toner development stations, receiving element such as paper used to transfer the latent image to, and cleaning fur brush or blade used to remove untransferred toner particles. In addition, the surface of the electrostatographic element is exposed to harmful byproducts of corona wires such as ozone and nitrous oxides. Further, any hard particle falling on the electrostatographic element surface can damage when going through a transfer or cleaning nip. Therefore it is desirable that the electrostatographic imaging element be made of highly wear and abrasion resistant ceramic materials. Unfortunately, commonly used ceramic materials such as alumina and zirconia, are highly electrically insulating in nature, which prevents these materials to be used as electrostatographic imaging element. It is desirable to have an integrated thin conductive surface on an insulative ceramic substrate and use it as an electrostatographic imaging element.

As can be readily appreciated from the discussions of the foregoing prior art problems, it is desirable to find a cost effective method that can be utilized to form a totally integrated conductive surface on an insulating ceramic substrate. The chemical composition of the laser irradiated conductive ceramic layer is akin to the insulating ceramic substrate which is irradiated, and in addition, since the conductive layer is not a coating, the integrated capacitor-like device thus produced can be used in many electronic applications more efficiently than those are currently being used. The advantage of this conductive layer is that it is not a coating or a lamination but an integral and continuous part of the substrate.

Formation of laser induced electrical conductivity is described in a German Patent No. 145,581-DD by Rolf Geisler who disclosed the surface of a ceramic material which was thermally decomposed to a conductive metal upon irradiation by a laser or an electron beam. Geisler sets forth that he forms a conductive film on an insulative ceramic body, capacitors can be produced.

Nathaniel R. Quick describes in U.S. Pat. No. 5,391,841 enhanced thermal and electrical properties of thermal sprayed ceramic coating on metal substrates for high-power integrating substrates provided by focused thermal energy sources such as laser processing. Laser induced reflow and recrystallization of ceramic material causes a purification or purging by vaporizing deleterious impurities and changing the crystalline structure while densifying the resulting structure of the ceramic layer with desired dielectric properties. Subsequent to the laser treatment a metal coating is deposited by plasma spray.

Ceramic capacitors are used widely because of their high dielectric strength and durability against heat. The most common process involves bonding thin ceramic layers or ceramic coating on metal substrates for support of the ceramic and as a means for dissipating heat generated by circuit components mounted on the circuit board thereon. However, such conventional processes do not provide the desired results. Traditionally, alumina ceramic has been used with such metals as copper, aluminum, etc. because of the ease if availability. Prior art devices described above have proven to be not that efficient because of poor bond strength between the alumina ceramic and the various metal electrodes. Further, these ceramic materials in combination with copper or aluminum electrodes have been found to be incompatible at elevated temperature operations because of the difference of thermal expansion of two dissimilar materials. Also, these devices are plagued by low dielectric properties and debonding characteristics of coatings when used at high power levels.

SUMMARY OF THE INVENTION

It is an object of the present invention to provide an electrostatographic apparatus which can readily form electrostatic images when illuminated by a light source.

In accordance with the present invention, it has been discovered that a conductive ceramic surface layer can be produced on an otherwise insulating ceramic by exposing to light.

The above object is achieved by an electrostatographic apparatus for providing images on a receiver, comprising:

(a) an electrostatographic element movable along a path, having:
  (i) a substrate;
  (ii) an alloyed zirconia ceramic layer formed over the substrate and having an image receiving surface; and
  (iii) the image receiving surface of the alloyed zirconia ceramic layer being adapted to become electrically conductive when illuminated by a light source;

(b) means for illuminating the image receiving surface with light in the pattern corresponding to an image so that the image receiving surface has electrically conductive and nonconductive portions which taken together represent the image;

(c) means for charging the image receiving surface such that charge remains on the nonconductive portions of the image receiving surface;

(d) means for providing charged toner particles which adhere to the image receiving surface in the electrically conductive portions defining a developed image; and (e) means for transferring the charged toner particles defining the developed image to the receiver and means for fixing the charged toner particles to the receiver.

The advantages of the present invention include:

1. A very cost-effective method of forming an electrically conductive pattern on an insulating ceramic using an IR laser.
2. The electrically conductive pattern is an integral and inseparable part of the insulating ceramic substrate and as a result is not amenable to delamination when used at high temperature.
3. X-ray diffraction shows the presence of tetragonal zirconia and no indication of presence of metallic zirconium to impart electrical conductivity.
4. The laser generated electrically conductive pattern is on a ceramic and therefore is resistant to very high operating temperature.
5. The ceramic electrostatographic element is highly wear and abrasion resistant.
6. The number of process steps are significantly reduced to produce an electrically conductive pattern on an insulating ceramic substrate because time consuming masking and coating processes are eliminated.

DETAILED DESCRIPTION OF THE PREFERRED EMBODIMENT

This invention relates generally to producing an electrostatography element by converting an insulating ceramic surface imagewise electrically conductive by irradiating with IR laser energy. This invention relates more particularly, to a method of obtaining electrical conductivity at room temperature on the surface of electrically insulating zirconia ceramic by irradiating with 1.06 $\mu$m radiation using a Nd:YAG laser. This invention teaches generation of a conductive layer on electrically insulating alloyed zirconia ceramic using some preselected operating parameters of a Nd:YAG laser. Unlike the prior art or traditional processes, conductive metal coatings are not deposited on a dielectric ceramic substrate or ceramic coatings on metal substrates and as a result the issues of debonding, delamination and device unreliability do not arise. According to this invention, the laser induced electrically conductive layer is an integral and inseparable part of the insulating ceramic substrate. A negative bias voltage is applied to the electrostatographic element (image receiving surface) wherein the laser induced electrically conductive pattern or image area dissipates the charge whereas the insulating area retains the charge thereby producing a latent image. Negatively charged toner particles are attracted toward conductive imaged areas and the image is transferred to a receiver and subsequently the image is fixed on the receiver by use of heat and pressure. Although a negative bias voltage is applied to the electrostatographic element, it should be understood that alternatively positive bias voltage can also be applied, the details of which is explained below.

Figure 1:
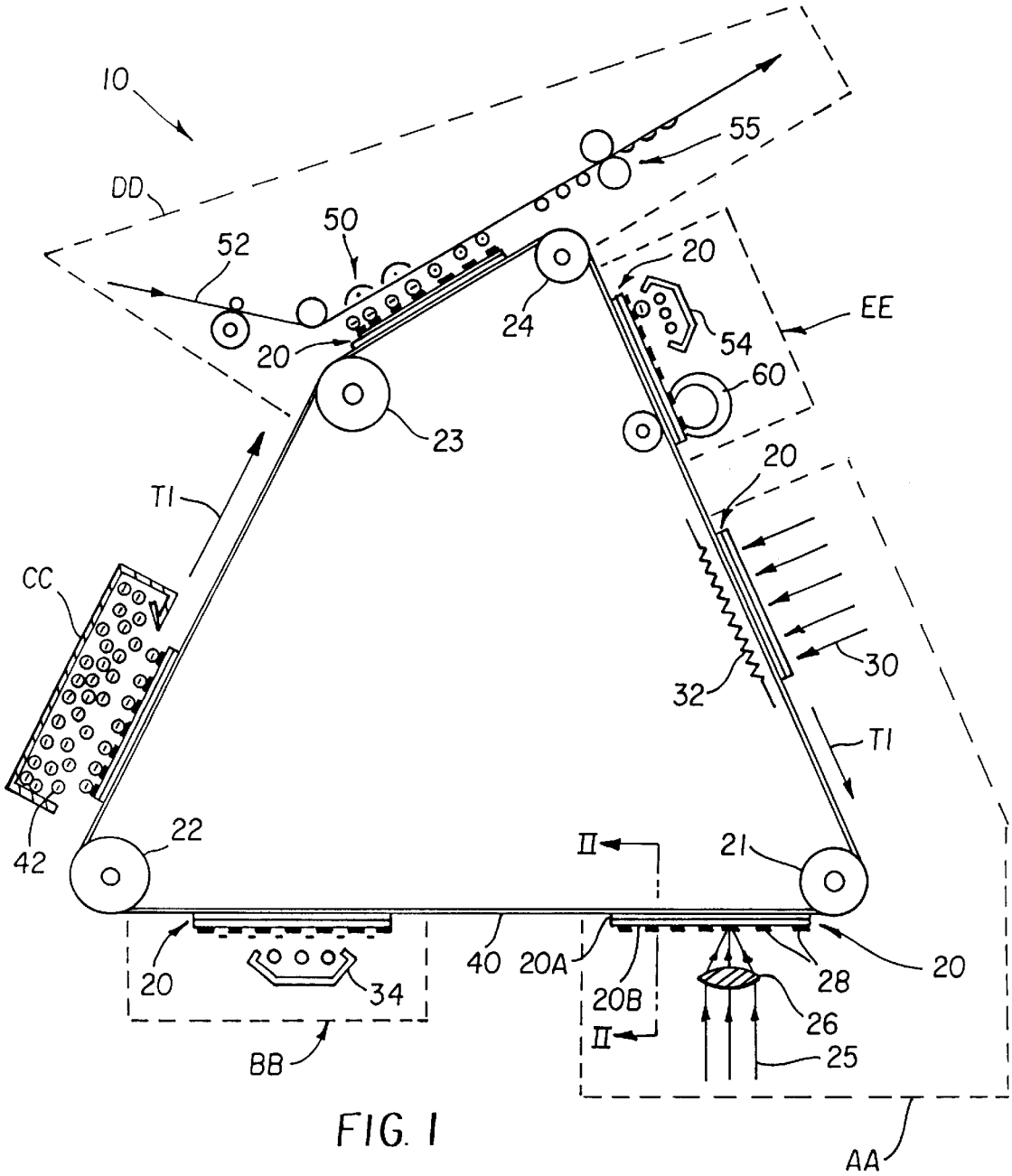
FIG. 1 is a schematic illustration of an electrostatographic apparatus made in accordance with the present invention.

Referring to FIG. 1, an electrostatographic apparatus 10 includes an image receiving surface 20 comprising a metal substrate 20A and alloyed zirconia ceramic 20B, the details of which will be described more fully below. The image receiving surface 20 is fixed on a movable flexible belt 40. Although the member 40 is shown as an endless movable flexible belt trained about the series of rollers 21–24, it should be understood that endless movable flexible belt need not be endless and also an image receiving surface in the form of a rigid drum can be used instead. The flexible belt 40 moves in the direction of the arrow T1. One of such rollers, for example, the roller 21, can be a drive roller for repeatedly moving the image receiving surface 20 sequentially through a series of process stages shown, for example, as AA, BB, CC and DD.

As illustrated in FIG. 1, clean and charge-free image receiving surface 20 initially moves through the stage AA where imagewise illumination with monochromatic IR light 25 through a condenser lens 26 is done to form an electrically conductive image 28 on the image receiving surface 20. The original document is scanned and stored digitally and the stored information drives the laser to write an electrically conductive image 28 on the image receiving surface 20. Typically, the stage AA includes components such as a IR laser or other illuminations sources 25 and 30 for writing and erasing respectively. Alternatively a heat source 32 can also be used to erase the conductive portion of the image on the image receiving surface 20.

Referring to FIG. 1 again, the image receiving surface 20 next moves to the stage BB where the image receiving surface 20 is charged using a corona charging source 34 and applying a potential to the metal substrate 20A wherein the insulating portion of the alloyed zirconia ceramic substrate 20B retains the negative charge. The applied potential can range from 100 to 800 VDC and could be either positive or negative depending on the charging polarity of the toner used. It is preferable to employ a discharge area development (DAD) mode wherein only the image wise irradiation would be required. Since, in general, the image content is less than 20 percent of the total area, choosing a DAD mode would reduce the need to irradiate large image areas. This would help in prolonging the life of the laser as well as reduce the amount of heat generated. If the charge area development (CAD) mode is used, then polarity of the toner would need to be opposite to that of the applied potential. The metal substrate 20A is grounded through the moving belt 40 and a thin electrically conductive paste is applied to one end of the conductive area 28 to ensure that all the conductive areas of the image receiving surface 20 correspond to a ground potential state. By providing a conductive path, an electric field can be established between the ceramic substrate and the toner development station CC. To the toning surface of CC, an electrical potential of 50 to 350 VDC is applied to facilitate the migration of the toner particles from the development station to the metal substrate 20A. The image of an original thus can be formed electrostatically on the image receiving surface 20 by IR laser radiation and then charging with a negative bias voltage.

An IR laser 25 having radiation frequency 1.06 $\mu$m (Nd:YAG laser) irradiates the alloyed zirconia substrates and create a conductive pattern as instructed by a personal computer as disclosed in commonly assigned U.S. Pat. No. 5,543,269. The following are the operating parameters of the Nd:YAG laser

| | |
|---|---|
| Scan Speed | 1,000 m/s |
| Pulse Width | 10 kHz |
| Peak Power | 3.167 KWatts |
| Average Current | 22 A (range: 20.5–25 A) |
| Beam Diameter | 100–600 $\mu$m |

The area 28 on the alloyed zirconia image receiving surface 20 irradiated by the IR laser 25 turns black, and only under certain operating conditions of the laser, the black patterns 28 becomes electrically conductive. The electrical conductivity is believed to be a result of the substoichiometric oxidation state of zirconia $ZrO_{2-x}$. X-ray diffraction pattern of the surface by glancing angle process indicates the presence of tetragonal zirconia and no indication of presence of metallic zirconium. The electrical conductivity was measured by applying a steady 25 VDC across two ends of the laser induced black image having approximately 1 cm×1 cm area, and measuring the current. The measured electrical resistivity for a given sample was 200 Ωcm and varied between 200 and 500 Ωcm.

Referring to FIG. 1 once again, the image receiving surface 20 next moves to the development stage CC wherein the latent image thereon is developed, that is, made visible, with charged toner particles 42. The latent image can be developed by a number of schemes, such as those described in Section 2.5 of Electrophotography by R. M. Schaffert, pp. 34–48. However, the preferred development scheme is based on hard ferrite particles as disclosed in U.S. Pat. 4,546,060 by Miskinis et al. In the preferred embodiment, the development stage CC consists of a toning roller in which the 12 pole magnetic core (not shown) is rotated at 1000 rpm and the shell is rotated at 15 rpm along with the developer. The developer is comprised of a charged toner and a resin coated carrier based on a strontium hard ferrite core. The development speed is maintained at 2–40 inches per second. In the development zone CC about 250 VDC bias is applied to the shell. Following the development, the image receiving surface 20 contains a toned image on its surface. It must be understood that the toner adheres only to the conductive area 28 of the image receiving surface 20.

During development of the latent image at the development stage CC, the toner particles 42 in the developer material transfer to the image bearing surface 20, and there adhere to the electrically conductive area 28, thereby making the image visible. After such development, the image receiving surface 20 carrying the toner image thereon moves to the stage DD.

The stage DD, as shown in FIG. 1, includes an image transfer station 50 where the visible toner image on the image receiving surface 20 is transferred to a suitable receiver 52 in the form of a sheet or a roll which is fed in registration to the transfer station 50 along a receiver travel path. After such image transfer, the copy sheet then travels to a fusing station 55 where the toner image is permanently is fixed to the receiver copy using pressure and heat to form a hard copy. Meanwhile, the used image receiving surface 20 from which the toner image was transferred, moves on towards the final stage of cleaning and erasure.

To ensure continued production of high quality hard copies during subsequent cycles of the above imaging process, it is necessary to effectively clean such image receiving surface 20 before it is again reused. Such cleaning, therefore, must effectively remove any residual charges and residual toner particles remaining on the image receiving surface 20 following image transfer. Accordingly, such cleaning is carried out at stage EE where means are provided for removing electrical charges and toner particles. As shown, for example, the residual electrical charges can be neutralized by a corona 54 or removed by a discharge lamp (not shown), and the residual toner particles can be cleaned by a cleaning station 60 shown as a brush. The cleaning station 60, for example, may be any conventional apparatus such as a brush or roller, a blade or a magnetic brush cleaning apparatus which are well known to the artisans.

Figure 2:
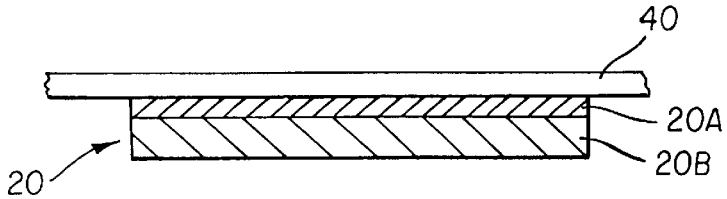
FIG. 2 is a cross-sectional view of the electrostatographic element taken along the lines II—II.

Referring now to FIG. 2, the image receiving surface 20 is illustrated in details. The image receiving surface 20 comprises of two essential elements: (1) an alloyed zirconia ceramic 20B which upon laser illumination turns black at the irradiated area and the black image portion is electrically conductive, and (2) an electrically conductive metal substrate 20A for the purpose of dissipating the electrical charges from the electrically conductive area 28 (see FIG. 1) after charging with a high voltage corona. Means are provided by either using a conductive paste, comprising silver particles or vacuum deposited electrically conductive coating to provide a conductive path between the electrically conductive image area 28 on the image receiving surface 20 and the metal substrate 20A. The image receiving surface 20 is anchored on to the moving flexible belt 40 by any convenient conventional means.

WORKING EXAMPLES

1. Zirconia powder alloyed with yttria (3 mole % yttria) is mixed with the following additives and dissolved in a solvent to form a slurry. The following formulation was used to make up the ceramic slurry for tape casting:

| | |
|---|---|
| Zirconia powder | 100 g |
| Methyl ethyl ketone/ethanol 50:50 mixture (solvent) | 25 g |
| Menhaden fish oil (deflocculant/dispersant) Tradename: DeflocZ3, 5pencerKelloggInc., Buffalo, NY | 0.8 g |
| Polyethylene glycol (plasticizer) | 7.5 g |
| Polyvinyl alcohol (binder) | 15 g |
| Tributylphosphate (defoaming agent) | 1.5 g |
| Isooctylphenylpolyethoxyethanol (wetting agent) 1 g | |

The above ingredients including the ceramic powder are added to a ball mill and milled for at least 6 hours to achieve thorough mixing. The slurry is then allowed to age overnight, then de-aired, viscosity is checked and ready for tape casting. The viscosity in this instance was maintained at 1000 to 1200 MPa The slurry is then cast onto a moving carrier surface of cellulose acetate and the slurry was spread to a controlled thickness with the edge of a doctor blade, which is known to the artisans. After the casting process, most of the solvent is evaporated away slowly by controlled heating or air flowing over the cast tape. The green tape is then placed in an oven for removing most of the binder and then sintered at 1300° C. for 2 hours. The long strips of sintered tapes are then cut into appropriate sizes using a diamond cut-off diamond saw.

2. A zirconia ceramic surface was written on using Nd:YAG at 1.06 $\mu$m. The zirconia ceramic surface turned black in conductive portions and remained white in nonconductive portions (non-written area). The conductive portions were erased with a $C0_2$ laser at 10.06 $\mu$m.

As can be readily appreciated from the foregoing discussion of the prior art problems, it is desirable to find a cost effective method that can be utilized to form a totally integrated conductive surface on an insulating ceramic substrate. The chemical composition of the laser irradiated conductive ceramic is akin to the insulating ceramic and in addition since the conductive surface is not a coating, the integrated capacitor-like device thus produced can be used in many electronic applications more efficiently than those are currently being used.

The invention has been described in detail with particular reference to certain preferred embodiments thereof, but it will be understood that variations and modifications can be effected within the spirit and scope of the invention.

PARTS LIST

10 electrostatographic apparatus
20 image receiving surface
20A metal substrate
20B alloyed zirconia ceramic
21–24 rollers
25 IR light or laser
26 condenser lens
28 conductive image
30 IR laser or illumination source
32 heat source
34 corona charging source
40 movable flexible belt
42 charge toner particles
50 image transfer station
52 receiver
54 corona
55 fusing station
60 cleaning station

What is claimed is:

1. An electrostatographic apparatus for providing images on a receiver, comprising:

(a) an electrostatographic element movable along a path, having:

(i) a substrate;

(ii) an alloyed zirconia ceramic layer formed over the substrate and having an image receiving surface; and (iii) the image receiving surface of the alloyed zirconia ceramic layer which becomes electrically conductive when illuminated by a light source having frequency and power sufficient to cause the image receiving surface to become electrically conductive;

(b) means for illuminating the image receiving surface with light in a pattern corresponding to an image so that the image receiving surface has an electrically conductive portion and a nonconductive portion which taken together represent the image;

(c) means for charging the image receiving surface such that charge remains on the nonconductive portion of the image receiving surface;

(d) means for providing charged toner particles which adhere to the image receiving surface in the electrically conductive portion defining a developed image; and (e) means for transferring the charged toner particles defining the developed image to the receiver and means for fixing the charged toner particles to the receiver.

2. The electrostatographic apparatus of claim 1 further including:

(f) means for erasing the electrically conductive portion by exposing to a light or heat source.

3. The electrostatographic apparatus of claim 1 wherein the alloyed zirconia ceramic layer is alloyed with 0.5 through 5.0 mole % yttria.

4. The electrostatographic apparatus of claim 1 wherein the light is provided by a monochromatic radiation source of approximately 1.06 $\mu$m.

5. The electrostatographic apparatus of claim 1 wherein the conductive portion has electrical resistivity of about 200 $\Omega$m.

6. The electrostatographic apparatus of claim 1 wherein the electrically conductive portion is black and the nonconductive portion is white.

* * * * *